US006761177B1

(12) United States Patent
Kedem-Shabi et al.

(10) Patent No.: US 6,761,177 B1
(45) Date of Patent: Jul. 13, 2004

(54) SWAB FOR MAKE-UP REMOVAL

(76) Inventors: Anat Kedem-Shabi, 6 HaMaavak St., Ramat HaSharon (IL), 47243; Avi Eran Shabi, 6 HaMaavak St., Ramat HaSharon (IL), 47243

( * ) Notice: Subject to any disclaimer, the term of this patent is extended or adjusted under 35 U.S.C. 154(b) by 0 days.

(21) Appl. No.: 10/110,744

(22) PCT Filed: Oct. 5, 2000

(86) PCT No.: PCT/IL00/00624

§ 371 (c)(1),
(2), (4) Date: Jun. 6, 2002

(87) PCT Pub. No.: WO01/28382

PCT Pub. Date: Apr. 26, 2001

(30) Foreign Application Priority Data

Oct. 18, 1999 (IL) ..... 132445

(51) Int. Cl.[7] ..... A45D 40/24; A45D 40/26; A45D 29/18

(52) U.S. Cl. ..... 132/317; 132/320; 132/74.5; 132/318

(58) Field of Search ..... 401/266, 130; 604/358, 1, 2, 3; 15/208, 209.1, 222, 230.12; 132/320, 218, 318, 317, 74.5; 206/209, 210, 229

(56) References Cited

U.S. PATENT DOCUMENTS 2,218,862 A * 10/1940 Vredenburgh ..... 132/320
2,606,565 A * 8/1952 Sage ..... 132/320
4,778,457 A * 10/1988 York ..... 604/290
4,887,994 A * 12/1989 Bedford ..... 604/1
4,952,204 A * 8/1990 Korteweg ..... 604/1
5,991,960 A * 11/1999 Johnson ..... 15/201.1
5,996,780 A * 12/1999 Gurrera ..... 206/209

* cited by examiner

*Primary Examiner*—Robyn Kieu Doan
(74) *Attorney, Agent, or Firm*—Marsteller & Associates, P.C.

(57) ABSTRACT

A swab comprising a handling element (1), at least at one end with a tip (2) made of an absorbent material. The tip (2) is impregnated with a make-up removing composition and shaped such that it has at least one apex (6). The make-up removing solution may be an eye make-up removing composition. The tip may be shaped in the shape of a triangle. The handling element (1) may be a stick made of polymeric materials or wood and connected to the tip (2) such that at least one side (4) and one vertex of the triangle are positioned opposite to the handling element (1). The swabs are packaged.

9 Claims, 1 Drawing Sheet

SWAB FOR MAKE-UP REMOVAL

FIELD OF THE INVENTION

The present invention relates to the field of cosmetics, particularly, make-up removal and means thereof.

BACKGROUND OF THE INVENTION

A wide array of different types of make-up are used in theatre, cinema and for cosmetic reasons. Among these are types of eye make-up such as mascara that is applied to the eyelashes, eyeshadow which is applied to the upper eyelid and eyeliner used to outline the free margin of eyelids near the eyelashes. A further type of make-up is for application to the lips, e.g., lipstick and lip-liner. A person who applies make-up often wishes to remove the make-up, leaving the skin clean, before retiring or before applying make-up again, or wishes to remove make-up from very particular spots in order to touch-up the make-up. This is important for all users of make-up, but particularly actors in the theater and in cinema, performers and models. This removal is often problematic from sensitive areas such as the area of the eyes and the lips since it requires precision handling. Currently the common practice for precision removal of make-up is to wet a cotton swab, of the commercially available type, and then to apply the wet swab to the area or the spot from which the make-up is intended to be removed. The problem with this practice is in the rounded shape of the swab which makes precision removal of make-up difficult. Furthermore, a make-up remover composition is not always at hand when needed, thus the user resorts to the use of other less appropriate liquids such as water which may adversely effect the texture of the skin or cause irritation. Many make-up removal compositions are available, the majority of them are in liquid form, and some are creams and gels. The compositions intended for removing eye make-up are required to be non-irritant to the skin and to the eye. The common practice for removing eye make-up is dabbing a piece of cotton or another absorbent material, perhaps a pad, with a make-up remover and gliding the pad or cotton over a closed eye, thus removing all the make-up at once. The disadvantage of this method is in that some of the make-up remover composition may penetrate the eye together with the make-up being removed, resulting in some irritation of the eye. Furthermore, the removing composition and absorbent material are kept separate. This is inconvenient, particularly, when traveling, since it requires carrying the remover, and cotton or pads separately.

A partial improvement which overcomes the aforementioned disadvantages is disclosed in U.S Pat. No. 3,472,242 which teaches a contoured pad impregnated with a make-up removing composition, which enables to remove eye make-up in a finer matter, without the need to wipe the entire outer surface of the eye. Furthermore, it incorporates the remover composition in the preabsorbed pad. The disadvantage of the aforementioned invention is in the handling of the pad. Accordingly, the user is required to touch the pad which is absorbed with the remover composition. This may result in the transfer of contaminants from the user's hand to the pad and subsequently to the eye, which may cause eye irritation. Furthermore, the handling of the pad itself may result in the loss of remover composition as a result of squeezing the pad, this causing unnecessary waste and untidiness. Furthermore, the cosmetic removal pad described in U.S. Pat. No. 3,472, 242 is not suitable for precision removal of make-up from small areas or spots as often required by people who apply make-up and wish to touch-up the make-up, particularly performers, such as actors and models. A cosmetic removal equipment utilizing a pointed bulb is described in EP-A-0 878 146 which can be utilized to some extent for precise removal of cosmetics.

Currently, there is not a device specifically for precision removal of make-up from small areas or spots, hereinafter touching-up. Wedged shaped brushes which are available are intended for make-up application and are not suitable for touching-up.

Thus, there is a need for a make-up removing device which is better suited for precision removal of make-up touching-up.

Furthermore, there is a long felt need to find a solution for touching-up which overcomes the need for a separate remover composition and remover device.

Furthermore, there is a need for a make-up removing device which provides a solution for the aforementioned shortcomings of the prior art.

Thus it is a purpose of the present invention to provide a device for make-up removal which provides for precision removal of make-up.

It is a further purpose of the present invention to obviate the need for a separate touching-up device and a make-up removing composition.

Other objects of the invention will become apparent as the description proceeds.

SUMMARY OF THE INVENTION

The present invention provides a swab comprising a handling element, (hereinafter referred to as a "stick") that is provided, at least at one end, with absorbent material, hereinafter "tip", characterized in that the tip is impregnated with a make-up removing composition, preferably, an eye make-up removing composition. The tip is shaped such that it has at least one apex. Preferably, the tip is shaped in the shape of a triangle. The stick is preferably connected to the tip in such a way that at least one side and one vertex of the triangle are positioned opposite the handling element.

DETAILED DESCRIPTION OF PREFERRED EMBODIMENTS OF THE INVENTION

Figure 1:
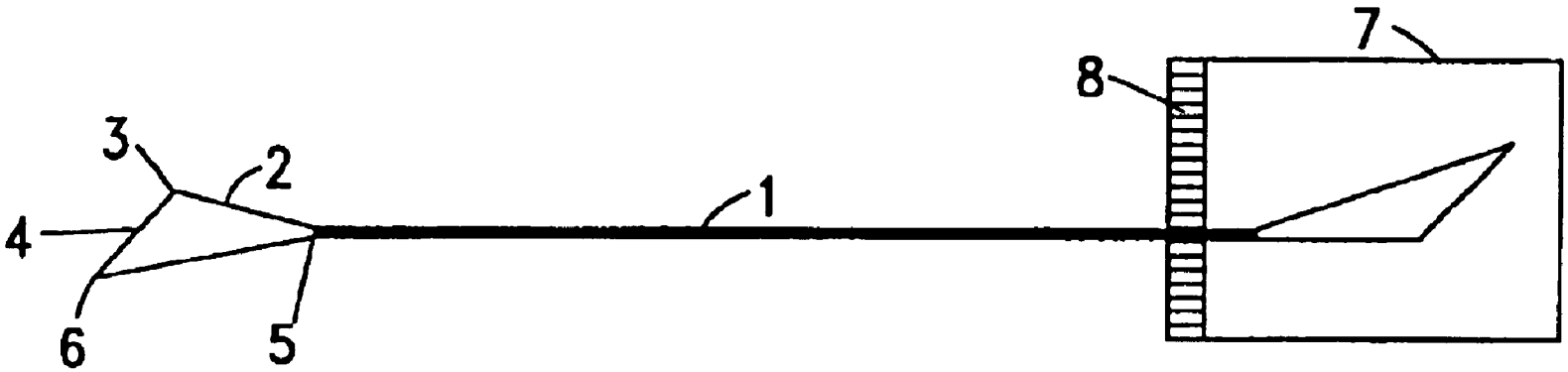
FIG. 1 is a plan view of a preferred embodiment of the swab of the present invention.
Figure 2:
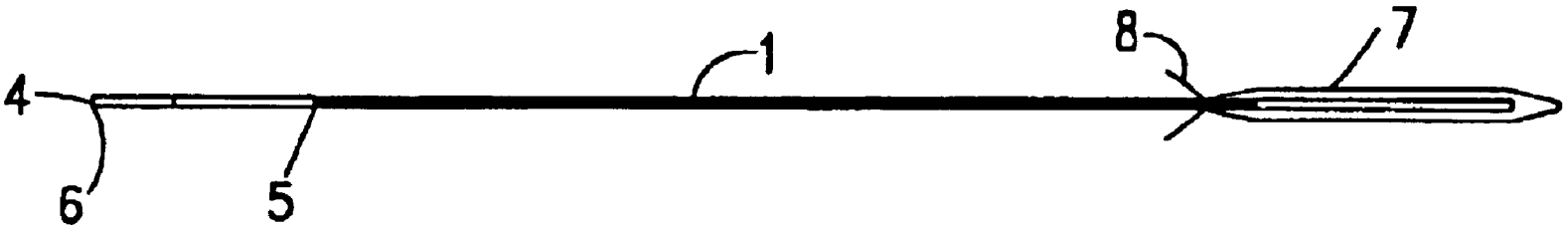
FIG. 2 is a side view of a preferred embodiment of the swab of the present invention.

The following description is illustrative of a preferred embodiment of the invention, with particular reference to FIG. 1. The following description is not to be construed as limiting, it being understood that the skilled person may carry out many obvious variations to the invention.

According to a preferred embodiment of the invention the handling element is a stick (FIG. 1, (1)) made of a material selected from among polymeric materials or wood, preferably, polymeric material. The stick is provided with two tips (FIG. 1, (2)) made of absorbent material selected, e.g., from among polymeric foams and fibrous materials, preferably cotton. The tips are impregnated with an eye make-up remover composition, which may be selected from a wide array of commercially available compositions in liquid, gel or cream form. The tips are preferably shaped in the shape of an obtuse triangle and are mounted on the stick such that the obtuse angle (FIG. 1, (3)) and a side of the triangle (FIG. 1, (4)), hereinafter the edge of the tip, are positioned opposite the point of connection (FIG. 1, (5)) of the stick with the tip. A particular point at the vertex of the triangle (FIG. 1, (6)), hereinafter called "the apex of the tip", is positioned so that the user of the swab may remove make-up from areas which require precision application of the swab, e.g., the free margin of the eyelid, where the eyeliner is applied and the contour of the lips. The edge of the tip can be used for removing make-up from broad areas of the eye, such as the upper and lower eyelids. The swab of the present invention is particularly useful for touching-up make-up.

Such a touch-up particularly relates to instances when make-up such as eye-liner, lipstick or lip-liner are applied in an undesirable way, e.g., the make-up exceeds the boarders of the intended area for the make-up, such as lip-liner or lipstick applied beyond the area of the lips, or eye-liner which is not applied properly to the free-margin of the eye lid. In such instances, rather than completely removing the make-up, one may use a swab of the present invention to precisely remove the make-up, only from the precise spot or area by using the apex of the tip which is impregnated with a make-up removing composition. The convenience provided by the swab of the present invention, which is specifically shaped for the touching-up of make-up and is packaged so that it is impregnated with make-up remover composition, is an important feature of the present invention.

In yet a further embodiment of the invention, the swabs are packaged together in a container that contains a make-up removing composition, such that the absorbent tips are constantly submerged in the composition. The size of the container and the number of swabs in the container may be fitted to the needs of the user, that is from large containers with hundreds of swabs, for use by professional make-up artists, to personal size containers which may be carried in a persons hand bag, containing a relatively small number of swabs.

According to a further preferred embodiment of the invention, each swab is individually packaged such that the tips are sealed between two sheets of impermeable material (FIG. 1, (7)) welded together. Thus, preventing leakage of the make-up remover composition from the absorbent tip, and maintaining the tips absorbed with the composition. The sheets may be separated by pulling the tab (FIG. 1, (8)) of each sheet.

The above description is illustrative of preferred embodiments of the invention, it being understood that many variations and modifications of the invention may be carried out without departing from the spirit of the invention or exceeding the scope of the claims.

What is claimed is:

1. A swab for make-up removal and make-up touching up comprising: a handling element and at least one monolithic triangular shaped tip (2), each tip, being connected to a corresponding end of the handling element, wherein:

each tip has at least two apexes (3 and 6);

one of said apexes is defined by an obtuse angle formed on said tip; and each of said tips is made of an absorbent material, and is impregnated with a make-up removing composition.

2. A swab according to claim 1 wherein the make-up removing composition is an eye make-up removing composition.

3. A swab according to claim 1 wherein the handling element (1) is connected to a tip (2) such that at least one side (4) and one apex of the triangle are positioned opposite the handling element (1).

4. A swab according to claim 1 wherein the handling element (1) is a stick made of a material selected from among polymeric materials or wood.

5. A swab according to claim 1 wherein the handling element (1) is provided with at least two triangular tips, such that said at least two triangular tips are in the same plane.

6. A swab according to claim 1 wherein each tip (2) is made of a material selected from among polymeric absorbent foams or fibrous materials.

7. A swab according to claim 6 wherein each tip (2) is made of cotton.

8. A container including at least one swab according to claim 1 wherein each swab is packaged in said container (7) such that the tips are immersed/submerged in the make-up remover composition, and wherein said container is comprised from at least two sheets of impermeable material welded together and a pulling tab (8) for sealing said container.

9. A swab according to claim 1 wherein each tip comprises a top plane, a bottom plane parallel to said top plan, and three side planes (4) having an essentially uniform width.

* * * * *